US011286815B2

(12) United States Patent
Benichou et al.

(10) Patent No.: US 11,286,815 B2
(45) Date of Patent: Mar. 29, 2022

(54) ROTOR DRUM FOR A TURBOMACHINE

(71) Applicants: SAFRAN AERO BOOSTERS, Herstal (BE); SAFRAN AIRCRAFT ENGINES, Paris (FR)

(72) Inventors: Sami Kelim Benichou, Moissy-Cramayel (FR); Arnaud Michel Marie Accary, Moissy-Cramayel (FR); Grégoire Decock, Moissy-Cramayel (FR); Guillaume Lescurat, Moissy-Cramayel (FR); Ludovic Pericaud, Moissy-Cramayel (FR)

(73) Assignees: SAFRAN AERO BOOSTERS, Herstal (BE); SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/871,479

(22) Filed: May 11, 2020

(65) Prior Publication Data

US 2020/0362702 A1 Nov. 19, 2020

(30) Foreign Application Priority Data

May 13, 2019 (FR) ..... 1904970

(51) Int. Cl.

| | |
|---|---|
| ***F01D 5/08*** | (2006.01) |
| ***F01D 5/02*** | (2006.01) |
| ***F01D 25/32*** | (2006.01) |
| ***F01D 5/06*** | (2006.01) |

(52) U.S. Cl.

CPC ..... *F01D 25/32* (2013.01); *F01D 5/022* (2013.01); *F01D 5/06* (2013.01); *F05D 2240/20* (2013.01); *F05D 2250/141* (2013.01); *F05D 2260/602* (2013.01); *F05D 2260/605* (2013.01)

(58) Field of Classification Search

CPC . F01D 25/32; F01D 5/06; F01D 5/084; F16N 31/00; F16C 33/6685

See application file for complete search history.

(56) References Cited

U.S. PATENT DOCUMENTS

| | | | | |
|---|---|---|---|---|
| 2014/0147249 | A1* | 5/2014 | Little | F01D 25/32 415/68 |
| 2015/0275693 | A1* | 10/2015 | Reichert | F01D 25/243 415/214.1 |
| 2016/0327065 | A1* | 11/2016 | Boewing | F04D 29/321 |
| 2017/0051823 | A1* | 2/2017 | Pikovsky | F01D 25/18 |

FOREIGN PATENT DOCUMENTS

EP 3 192 966 A1 7/2017

OTHER PUBLICATIONS

Rapport De Recherche Preliminaire and Opinion dated Jan. 14, 2020, for French Application No. 1904970, filed May 13, 2019, 6 pages.

* cited by examiner

*Primary Examiner* — Justin D Seabe

(74) *Attorney, Agent, or Firm* — Christensen O'Connor Johnson Kindness PLLC

(57) ABSTRACT

A rotor drum for an aircraft turbomachine includes an annular wall extending around a longitudinal axis (A), the annular wall carrying rotor blades and having at least one bleed device configured to allow at least one liquid to pass through the annular wall. The bleed device includes a series of three adjacent circular orifices, the three orifices being aligned along a line and having a central orifice of larger diameter D1 and two lateral orifices of smaller diameter D2 diametrically opposed with respect to the central orifice.

9 Claims, 3 Drawing Sheets

[Fig. 1]
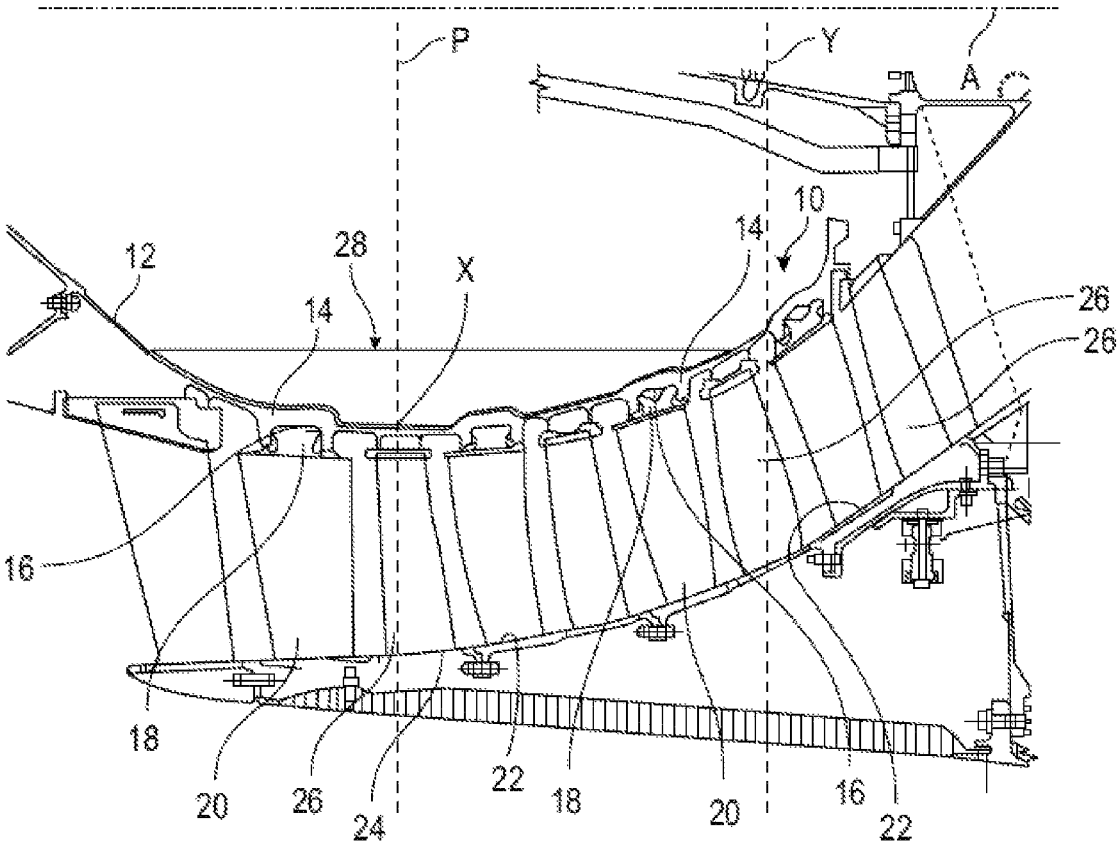

[Fig. 2]
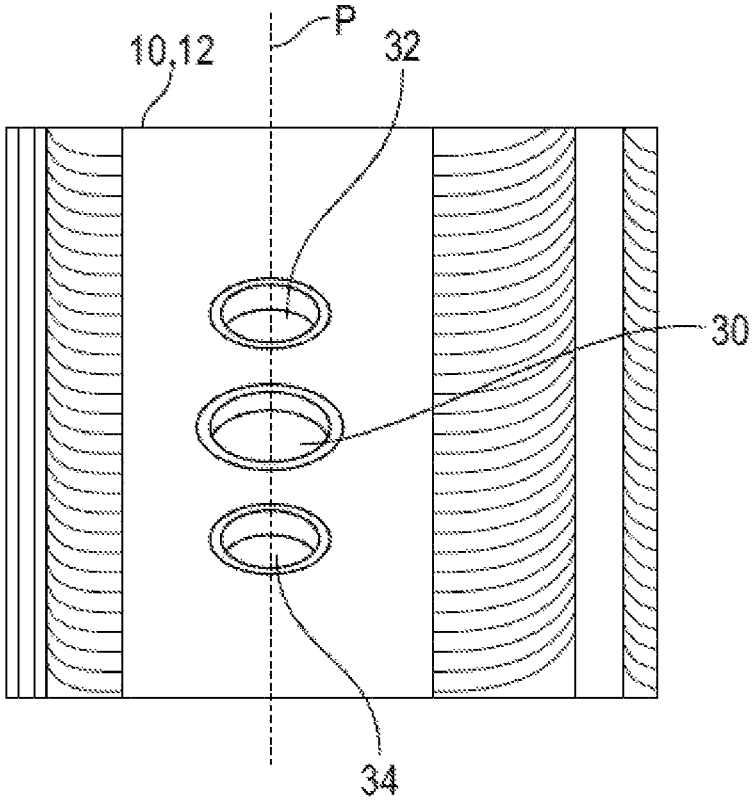

[Fig. 3]
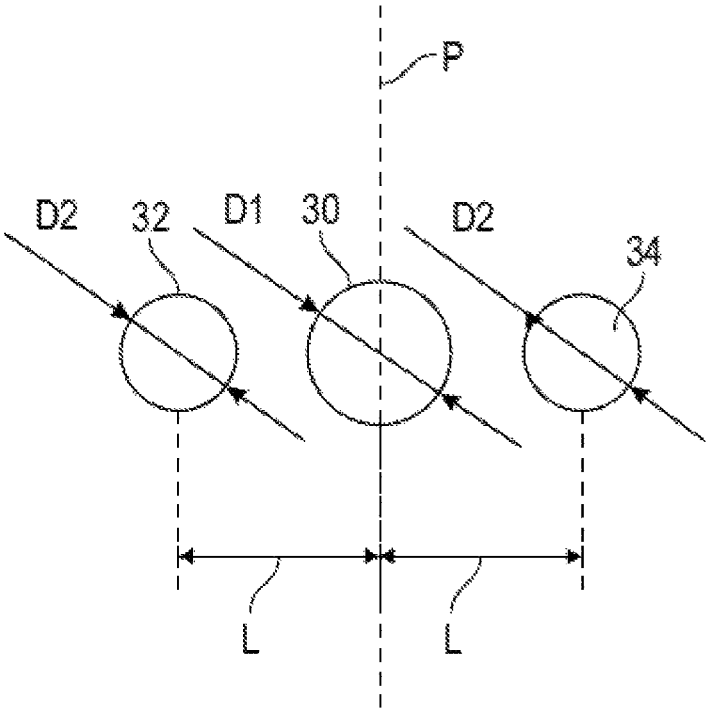

ROTOR DRUM FOR A TURBOMACHINE

CROSS REFERENCE TO RELATED APPLICATION

This application claims priority under 35 U.S.C. § 119 to French Patent Application No. 1904970, filed May 13, 2019, which is herein incorporated by reference in its entirety.

FIELD

Embodiments of the present disclosure relate to a rotor drum for an aircraft turbomachine, as well as a turbomachine comprising such a drum.

BACKGROUND

The background includes EP-A1-3 192 966.

An aircraft turbomachine may comprise several rotating bodies or rotors that rotate inside stators. A turbomachine rotor, such as a compressor or turbine rotor, comprises several rotor blades that are intended and configured to be interposed between stator blades. In this application, a blade is defined as comprising an annular row of vanes.

A turbomachine rotor can be made by assembling a plurality of coaxial discs, each disc carrying an annular row of rotor vanes and being fixed to adjacent discs by fastening means of the screw-nut type. The vanes may be attached and fixed to a rotor disc or may be formed in one-piece with the latter (in the case of a one-piece bladed disc or blisk).

A turbomachine rotor may be produced by means of a drum which comprises a one-piece wall of revolution extending around a longitudinal axis and capable of carrying several rotor blades.

FIG. 1 shows an example of embodiment of a turbomachine drum 10. The wall 12 of the drum 10 can be domed and barrel-shaped. Its external diameter therefore varies between its axial ends and is largest in a transverse plane denoted P.

FIG. 1 shows a half lower section of the drum and therefore the lower part of this drum. The point X is a low point or the lowest point of the drum and is located in the largest diameter plane P of the drum 10. The drum is movable in rotation so the point X moves on the drum.

The wall 12 comprises annular thickeners 14 in which are formed as annular grooves 16 which open radially outwards with respect to the axis A. These grooves 16 have a cross-sectional shape adapted to retain the roots 18 of the rotor vanes 20. All the vanes 20 mounted in a single groove 16 form a rotor blade.

The radially outer tips or ends of the vanes 20, opposite the roots 18, are surrounded by layers 22 of abradable material carried by a stator casing 24. In addition, the casing 24 has stator blades 26 interposed between the rotor blades.

The barrel shape of the drum 10 is dependent on the shape of the flow vein of the gas stream and in the case of the presence of liquid in the drum 10, the resulting bulge generates an annular liquid retention area 28, as shown in FIG. 1.

Indeed, during operation, oil, fuel or water can accumulate in the drum. It is important to drain off these liquids to prevent their retention.

Embodiments of the present disclosure provide a simple, effective and economical solution to the need mentioned above.

SUMMARY

This summary is provided to introduce a selection of non-limiting concepts in a simplified form that are further described below in the Detailed Description. This summary is not intended to identify key features of the claimed subject matter, nor is it intended to be used as an aid in determining the scope of the claimed subject matter.

Embodiments of the present disclosure relate to a rotor drum for an aircraft turbomachine, comprising an annular wall extending around a longitudinal axis, the wall carrying rotor blades and comprising at least one bleed device configured to allow at least one liquid to pass through the wall, wherein the device comprises a series of three adjacent circular orifices, the three orifices being aligned along a line and comprising a central orifice of larger diameter D1 and two lateral orifices of smaller diameter D2 diametrically opposed with respect to the central orifice.

The inventors have thus developed a bleed device optimized for the flow and discharge of liquids, such as oil, fuel or water, through the wall of the drum. This solution is advantageous with respect to a single orifice, which could weaken and thus further reduce the mechanical strength of the part. In this case, the orifices can have cumulative passage sections equivalent to that of a single orifice while controlling and limiting the impact on the mechanical strength of the drum. This solution is also advantageous compared to a non-circular orifice such as an oblong or elliptical orifice, because these types of orifices are complex and expensive to make, as they generally require a specific machining machine, an increased control of the tool paths and more precise dimensional control in order to be able to properly characterize these complex shapes.

The orifice diameters can be selected according to the volume of liquid to be bled per minute and in line with the number of devices of the drum and their respective locations. The diameters and locations of the orifices take account of the dimensional constraints of manufacture and strength of the drum, in particular when it has to undergo treatment after the orifices have been made, for example shot-blasting.

The drum according to the present disclosure may comprise one or more of the following characteristics, taken in isolation or in combination with each other:

- the lateral orifices have the same diameter D2 within 10%, $D2<D1\leq 1.5.D2$,
- D1 is from 3 mm to 10 mm and D2 is from 2 to 8 mm, inclusive,
- the centers of the lateral orifices are located at the same distance L from the center of the main orifice, $D1\leq L\leq 2.D1$,
- L is from 5 to 15 mm, inclusive
- the orifices are aligned on a circumference centered on the longitudinal axis,
- the drum wall is made of metal alloy,
- the orifices are made by machining,
- the annular wall is one-piece or sectorized.

This present disclosure also relates to an aircraft turbomachine, comprising a drum as described above. Preferably, the drum comprises several bleed devices distributed on the same circumference centered on the longitudinal axis. Alternatively, the drum could comprise several devices distributed over several circumferences centered on the axis.

The present disclosure also relates to an aircraft comprising a turbomachine of the type described above.

DESCRIPTION OF THE DRAWINGS

The foregoing aspects and many of the attendant advantages of this present disclosure will become more readily appreciated as the same become better understood by reference to the following detailed description, when taken in conjunction with the accompanying drawings, wherein:

FIG. 1 is a partial schematic axial section view of an aircraft turbomachine, showing a rotor drum, FIG. 2 is a schematic perspective view of a representative embodiment of a bleed device according to the present disclosure, of the wall of a rotor drum, and FIG. 3 is a schematic view of the orifices of the device in FIG. 2.

DETAILED DESCRIPTION

FIG. 1 shows an example of embodiment of a turbomachine drum 10. The wall 12 of the drum 10 can be domed and barrel-shaped. Its external diameter therefore varies between its axial ends and is largest in a transverse plane denoted P.

FIG. 1 shows a half lower section of the drum and therefore the lower part of this drum. A point X is a low point or the lowest point of the drum and is located in the largest diameter plane P of the drum 10. The drum is movable in rotation so the point X moves on the drum.

The wall 12 comprises annular thickeners 14 in which are formed as annular grooves 16 which open radially outwards with respect to the axis A. These grooves 16 have a cross-sectional shape adapted to retain the roots 18 of the rotor vanes 20. All the vanes 20 mounted in a single groove 16 form a rotor blade.

The radially outer tips or ends of the vanes 20, opposite the roots 18, are surrounded by layers 22 of abradable material carried by a stator casing 24. In addition, the casing 24 has stator blades 26 interposed between the rotor blades.

The barrel shape of the drum 10 is dependent on the shape of the flow vein of the gas stream and in the case of the presence of liquid in the drum 10, the resulting bulge generates an annular liquid retention area 28, as shown in FIG. 1.

Indeed, during operation, oil, fuel or water can accumulate in the drum. It is important to drain off these liquids to prevent their retention.

The present disclosure provides a bleed device for a turbomachine drum 10 as shown in FIG. 1.

The drum 10 may comprise one or more devices and for example a device at the point X, e.g., in a lower part or in the lowest part of the drum when the drum is stationary in the turbomachine.

FIGS. 2 and 3 show a representative and non-limiting embodiment of the bleed device which comprises a series of three adjacent circular orifices 30, 32, 34. These three orifices 30, 32, 34 are aligned along a line and are a central orifice 30 of larger diameter D1 and two lateral orifices 32, 34 of smaller diameter D2 diametrically opposed with respect to the central orifice 30. In some embodiments, the three orifices 30, 32, 34 are the only orifices of the bleed device.

The alignment line of the orifices 30, 32, 34 is preferably a circumference centered on the axis A. Thus, orifices 30, 32, 34 are aligned on a circumference of the axis A, as shown in FIG. 2. Preferably, the angular orientation of the orifices is directed substantially on a line related to the specific stresses of the part. Thus, the orifice 30 is located at the point X, i.e., in the sectional plane of FIG. 1, and the orifices 32, 34 are diametrically opposed with respect to the orifice 30 and located respectively in front of and behind this plane and therefore not visible in FIG. 1.

The orifices 32, 34 have a same diameter D2. Preferably $D2<D1\leq1.5.D2$. As an example, D1 is from 5 mm to 10 mm (inclusive) and D2 is from 4 mm to 8 mm (inclusive).

The centers of the orifices 32, 34 are located at a same distance L from the center of the orifice 30. Preferably, $D1\leq L\leq2.D1$.

L is for example from 7.5 mm to 15 mm, inclusive.

The device according to the present disclosure makes it possible to bleed the drum efficiently by reducing the stresses in the location area of the device, and by facilitating their embodiment for example by machining and in particular drilling.

As mentioned above, the drum may comprise several bleed devices and therefore several series of three orifices. The devices are preferably located in the plane P and evenly distributed around the axis X. The increase in the number of devices on the same circumference ensures that at least one of the devices is located as close as possible to the point X.

Given that the axis A of the turbomachine is not always horizontal in use, in particular during the take-off and landing phases of the aircraft equipped with this turbomachine, the drum 10 is, in some embodiments, equipped with a bleed device or devices outside the plane X and, for example, downstream of this plane (by reference to the flow of gases in the vein of the turbomachine). FIG. 1 shows a plane Y passing upstream of the rotor blade of the fourth-stage, in which could be located bleed devices according to the present disclosure.

The detailed description set forth above in connection with the appended drawings, where like numerals reference like elements, are intended as a description of various embodiments of the present disclosure and are not intended to represent the only embodiments. Each embodiment described in this disclosure is provided as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the FIGURES and described in the specification. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed. For example, the present disclosure includes additional embodiments having combinations of any one or more features described above with respect to the representative embodiments.

In the foregoing description, specific details are set forth to provide a thorough understanding of exemplary embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure.

The present application may include references to directions, such as "first," "second," "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

The embodiments of the invention in which an exclusive property or privilege is claimed are defined as follows:

1. A rotor drum for an aircraft turbomachine, comprising:

an annular wall extending around a longitudinal axis, the annular wall being made of a single part and having annular grooves which open radially outwards with respect to the longitudinal axis;

rotor blades having roots which are mounted and retained into said annular grooves, wherein the rotor blades mounted in said annular grooves form an annular row of rotor blades, and wherein said annular wall carries a plurality of annular rows of rotor blades; and at least one bleed device configured to allow at least one liquid to pass through the annular wall, wherein said annular wall has a barrel shape, said barrel shape having a first longitudinal end, a second longitudinal end which is opposite to said first longitudinal end, and an annular bulge located between said first and second longitudinal ends and having an inner diameter which is larger than inner diameters of said first and second longitudinal ends, said annular bulge forming an annular liquid retention area which is located between two adjacent annular grooves, wherein the at least one bleed device comprises a series of three adjacent circular orifices, said three adjacent circular orifices being aligned along a line located in the annular liquid retention area and on a circumference centered on the longitudinal axis, and wherein said three adjacent circular orifices comprise a central orifice of a larger diameter D1 and two lateral orifices of a smaller diameter D2 diametrically opposed with respect to the central orifice.

2. The rotor drum according to claim 1, wherein $D2<D1\leq 1.5D2$.

3. The rotor drum according to claim 1, wherein D1 is from 3 mm to 10 mm and D2 is from 2 mm to 8 mm.

4. The rotor drum according to claim 1, wherein centers of each of the two lateral orifices are located at a same distance L from a center of the central orifice.

5. The rotor drum according to claim 4, wherein $D1\leq L\leq 2D1$.

6. The rotor drum according to claim 5, wherein L is from 5 mm to 15 mm.

7. An aircraft turbomachine comprising a rotor drum according to claim 1.

8. The turbomachine according to claim 7, wherein the rotor drum comprises at least one of:

a plurality of bleed devices distributed over a single circumference centered on the longitudinal axis (A), or a plurality of bleed devices distributed over several circumferences centered on the longitudinal axis (A).

9. An aircraft comprising a turbomachine according to claim 7.

* * * * *